US012680200B1

(12) United States Patent
Sellars et al.

(10) Patent No.: US 12,680,200 B1
(45) Date of Patent: Jul. 14, 2026

(54) SPRAY BOOTH AND SYSTEM FOR MANUFACTURE OF CELLULOSE INSULATION

(71) Applicant: Nature Tech LLC, Milwaukee, WI (US)

(72) Inventors: William Sellars, Milwaukee, WI (US); Thomas C. Shutt, Milwaukee, WI (US)

(73) Assignee: Nature Tech LLC, Milwaukee, WI (US)

( * ) Notice: Subject to any disclaimer, the term of this patent is extended or adjusted under 35 U.S.C. 154(b) by 69 days.

(21) Appl. No.: 18/605,091

(22) Filed: Mar. 14, 2024

Related U.S. Application Data

(60) Provisional application No. 63/490,431, filed on Mar. 15, 2023.

(51) Int. Cl.
*D01G 11/00* (2006.01)
*D06B 1/02* (2006.01)

(52) U.S. Cl.
CPC ..... *D01G 11/00* (2013.01); *D06B 1/02* (2013.01); *D10B 2201/00* (2013.01); *D10B 2505/00* (2013.01)

(58) Field of Classification Search
CPC .... D21H 23/50; Y10S 428/921; D01G 11/00; D01G 13/00; D01G 23/02; D06B 1/02
USPC ..... 162/159; 428/921
See application file for complete search history.

(56) References Cited

U.S. PATENT DOCUMENTS 4,168,175 A 9/1979 Shutt
4,173,666 A 11/1979 Quinto
4,174,223 A 11/1979 Steen
4,191,224 A 3/1980 Bontrager
4,203,755 A 5/1980 Ruckstuhl
4,228,202 A 10/1980 Tjannberg
4,228,964 A 10/1980 Brady
4,411,390 A * 10/1983 Woten ..... B65G 53/4633 406/64
4,465,239 A * 8/1984 Woten ..... B65G 53/46 406/64
4,572,815 A 2/1986 Kaiser
4,595,414 A 6/1986 Shutt
4,970,950 A 11/1990 Ahoste
5,366,095 A 11/1994 Martin
5,534,301 A 7/1996 Shutt
(Continued)

FOREIGN PATENT DOCUMENTS

CN 112522821 A * 3/2021 ..... D01G 13/00
WO 2016187304 A1 11/2016
(Continued)

OTHER PUBLICATIONS

Translation CN 112522821.*

*Primary Examiner* — Shaun R Hurley
(74) *Attorney, Agent, or Firm* — Andrus Intellectual Property Law, LLP

(57) ABSTRACT

A spray booth for producing cellulose insulation and a system for producing cellulose insulation uses the spray booth. Input cellulose material is fiberized and cellulose dust is removed from the fiberized cellulose material. The fiberized cellulose material is directed to a spray booth where cellulose fibers and matrices of cellulose fibers are sprayed with a liquid fire-retardant chemical to produce wetted cellulose fiber. The wetted cellulose fiber is dried in a dryer to produce cellulose insulation.

18 Claims, 9 Drawing Sheets

(56) References Cited

U.S. PATENT DOCUMENTS

| | | | | |
|---|---|---|---|---|
| 5,642,601 | A | 7/1997 | Thompson, Jr. | |
| 6,155,020 | A | 12/2000 | Deem | |
| 6,578,782 | B2 | 6/2003 | Elliot, Jr. | |
| 9,045,605 | B2 | 6/2015 | Shutt | |
| 10,767,306 | B2 | 9/2020 | Shutt | |
| 2004/0036191 | A1 | 2/2004 | Rodda | |
| 2004/0121114 | A1 | 6/2004 | Piana | |
| 2010/0086780 | A1* | 4/2010 | Shutt | C08J 3/203 427/289 |
| 2014/0079942 | A1 | 3/2014 | Lally | |
| 2014/0093742 | A1 | 4/2014 | Saari | |
| 2015/0147478 | A1 | 5/2015 | Shutt | |
| 2016/0355959 | A1* | 12/2016 | Young | D01G 13/00 |
| 2022/0162810 | A1* | 5/2022 | Nusca | D01G 13/00 |

FOREIGN PATENT DOCUMENTS

| | | | | |
|---|---|---|---|---|
| WO | 2017053554 | A1 | 3/2017 | |
| WO | WO-2022048972 | A1 * | 3/2022 | D01G 13/00 |

* cited by examiner

SPRAY BOOTH AND SYSTEM FOR MANUFACTURE OF CELLULOSE INSULATION

CROSS-REFERENCE TO RELATED APPLICATIONS

The present application claims priority of U.S. Provisional Application No. 63/490,431, filed on Mar. 15, 2023, the contents of which is incorporated by reference in its entirety.

FIELD OF THE DISCLOSURE

The present disclosure relates to the field of cellulose insulation processing. More specifically, the present disclosure relates to systems and methods of creating low-density and low-dust cellulose insulation from recycled materials.

BACKGROUND

Cellulose material is commonly used in residential and commercial construction, particularly in the form of thermal insulation in the walls and attic spaces. Insulation products of this type are designed to prevent heat loss and correspondingly insulate building structures from the outside environment. The cellulose must be chemically treated to impart properties before it can be used as insulation. These properties include, but not limited to fire, corrosion, and mold resistance as well as other requirements as specified in A.S.T.M C-739. Raw materials used to produce cellulose insulation products may involve many different paper compositions including recycled newspaper, cardboard, and paperboard. These materials are physically processed to produce a finely-divided material having a low bulk density.

The term "bulk density" as used herein is defined to encompass the weight (traditionally in lbs/ft$^3$) of the final settled insulation product. A final product with a low bulk density is desired because it imparts less weight to the building structure in which it is used. In addition, a final product with low bulk density is more free-flowing, easier to handle, and more readily installed. In addition, since cellulose insulation is typically sold by coverage (i.e., volume), an insulation material with a lower bulk density enables a manufacturer to sell less weight without diminishing performance.

To achieve an approved level of flame and smolder resistance, the selected cellulose materials are combined with fire retardant compositions during the production process. Exemplary fire-retardant compositions include but are not limited to monoammonium phosphate, diammonium phosphate, boric acid, borax, ammonium sulfate, sodium tetraborate, and mixtures thereof and are typically present in the final product between 12%-18% w/w. These materials, as well as other fire-retardant compositions and additional information regarding the production of cellulose insulation products, are discussed in U.S. Pat. No. 4,168,175 to Shutt and U.S. Pat. No. 4,595,414 to Shutt, the disclosures of which are incorporated herein by reference.

Traditionally, these processes apply the fire-retardant materials in a powder form during the physical processing of the cellulose materials, which may include multi-stage size reduction by grinding or other conventional processes using standard equipment including but not limited to hammermill and fiberizer systems. At selected stages during the size reduction process, often at or near the final grinding stages of the system, the fire-retardant composition in powder (dry) form is combined with the cellulose materials.

More recently, the inventors have developed cellulose insulation manufacturing processes which use liquid fire-retardant compositions. Such processes are described in U.S. Pat. Nos. 5,534,301; 9,045,605; and 10,767,306, each of which are incorporated by reference in their entireties. The liquid fire-retardant composition may include aqueous solutions of: ammonium sulfate, monoammonium phosphate, diammonium phosphate, boric acid, sodium tetraborate, ferrous sulfate, zinc sulfate, and mixtures thereof. Examples of fire-retardant chemicals include ammonium sulfate (alone), a mixture of about 93.7% wt. ammonium sulfate and about 6.3% wt. boric acid, and a mixture of about 40% wt. monoammonium phosphate and about 60% wt diammonium phosphate, which are ultimately combined with water to produce aqueous solutions. The aqueous solution has 35-42% by weight total of one or more fire retardant compounds dissolved therein.

FIG. 1 provides an example of a prior art system 100 for applying fire-retardant compositions on cellulose materials. Cellulose material 114 is loaded onto a platform such as a feed table 118 where the material 114 is sorted and separated from non-cellulose materials and other materials. A conveyor belt 122 routes the cellulose material 114 into a shredding apparatus 126 to physically reduce the size of the material to a desired level and produce a plurality of individual pieces of paper 130, which have an average width and length of about 2-6 inches (about 5-15 cm).

The individual pieces of paper 130 are then transferred from the shredding apparatus 126 into an air transport system 134 which uses an air flow to move the piece so paper to a spraying system 142 as the next stage of the system 100. A spray booth 150 delivers at least one liquid fire retardant composition 146 to the pieces of paper 130, and can include one or more spraying nozzles 154 connected to a tank 158 containing the selected liquid fire retardant composition.

The fire retardant soaked paper product 132 is transferred to a dying chamber 188 along with a stream of heated air 194. Prior to the passage of the fire retardant soaked paper product 132 into the drying chamber 188, the paper product 132 can be allowed to reside in one or more stationary hoppers 180 or containment vessels for a selected amount of time. The stream of heated air 194 is delivered into the drying chamber in an angled (A) and non-parallel orientation relative to the longitudinal axis X of the drying chamber 188. The angle A of the stream of heated air is perpendicular to the longitudinal axis X of the chamber 188. The fire retardant soaked paper product 132 is passed into and through the drying chamber 188 in combination with the stream of heated air 194 after completion of the dwell time period. The stream of heated air 194 is designed to simultaneously move the paper product 132 through the drying chamber 188 to achieve complete drying of the paper product 132 within the chamber.

To completely dry the fire retardant soaked paper product 132, the process involves temporarily interrupting passage of the fire retardant soaked paper product and heated air 194 through the drying chamber 188 periodically during movement of the ese components through the drying chamber 188. This step slows the flow of the paper product 132 and heated air 194 through the drying chamber 188, which enables greater contact between the heated air 194 and the paper product 132.

One or more stationary or movable baffle members 170 can temporarily and periodically interrupt the flow path of the fire retardant soaked paper product 132 and to the stream of the heated air 194 as they pass through the drying chamber 188.

After passage of the paper product 132 through the drying chamber 188, it exits the chamber 188 via outlet port 226. Within the chamber 188, drying of the paper product 132 produces A dried fire dash resistant cellulose insulation product 250 which is collected from the chamber 188 and further processed as desired to create a final product with additional size reduction and specific size characteristics. Size reduction can be accomplished for example using one or more hammermill units 254, 284, or other comparable systems known in the art for this purpose, to produce completed insulation product 300.

The size reduction processing to produce the dried fire resistant cellulose insulation product 300 typically produces a substantial quantity of dust which contains residues and chemicals of the fire retardant composition. Thus, the insulation product 300 is subjected to de-dusting 310. The de-dusting can be performed by any suitable process, for example, by screening, air classification, or other known separation techniques. The de-dusting is performed by a screening technique or screening in combination with another separation technique.

In examples of these processes, a liquid comprising a solvent and at least one fire-retarding material soluble in the solvent is applied to a cellulose source material. The liquid is applied in a fine mist comprising a plurality of droplets each having a diameter of about 40-200 microns. The liquid is allowed to permeate into the cellulose source material. The liquid permeated material is dried to remove the solvent while the fire-retardant material remains in the cellulose source material. The dried cellulose source material is then reduced in size to produce a fire-retardant cellulose fiber material. The size reduction is performed by one or more hammermill and/or fiberizer units until a final insulation product is produced. The process also produces a substantial quantity of "dust" or cellulose material having a fiber size equivalent or smaller than a US 60 sieve or 0.01 inch (0.025 cm). The fire-retardant cellulose fiber material is then de-dusted to remove this dust from the insulation material to produce a low-dust fire-retardant cellulose fiber material that has functionally equivalent fire-retardant properties as the fire-retardant cellulose fiber material before de-dusting.

BRIEF DISCLOSURE

A system for producing cellulose insulation, includes a shredder configured to receive a supply of input cellulose material and produce shredded cellulose material. A grinder is configured to receive the shredded cellulose material and reduce the shredded cellulose material to pieces of cellulose and cellulose dust. A fiberizer is configured to receive the pieces of cellulose and reduce the pieces of cellulose to cellulose fibers and matrices of cellulose fibers and cellulose dust. A de-duster is configured to receive the cellulose fibers and matrices of cellulose fibers and cellulose dust, and separate the cellulose fibers and matrices of cellulose fibers from the cellulose dust. A spray booth is configured to receive the cellulose fibers and matrices of cellulose fibers and further configured to spray liquid fire-retardant chemicals onto the cellulose fibers and matrices of cellulose fibers to produce wetted cellulose fiber. A dryer is configured to receive the wetted cellulose fibers and to dry the wetted cellulose fiber to produce cellulose insulation.

In examples of the system, the input cellulose material is cardboard. The grinder may be a hammermill. The cellulose dust may be collected from the de-duster as a fire-retardant chemical free biproduct. The cellulose fibers and matrices of cellulose fibers are fibers consistent with a fiber construction of the input cellulose material. The cellulose fibers have an average length between 0.01-0.2 in (0.25-5 mm). The de-duster may be configured to remove any cellulose fibers having a length less than 0.01 in (0.25 mm).

In an example of the system, the system further includes a second fiberizer and a metering bin. The metering bin has an interior and is configured to receive the pieces of cellulose from the grinder. The metering bin includes a first trough extending upwards into the interior, a first auger at a bottom of the first trough, the first auger operable to pull pieces of cellulose from the first trough to the first fiberizer, a second trough extending upwards into the interior, and a second auger at a bottom of the second trough, the second auger operable to pull pieces of cellulose from the first trough to the second fiberizer. At least one vane within the interior is configured to rotate to disperse the pieces of cellulose within the interior. A cyclone is above the metering bin, the cyclone receives the pieces of cellulose and directs the pieces of cellulose into the metering bin through a bin hole at a bottom of the cyclone and at a top of the metering bin.

In an example of the system, the dryer includes a conveyor configured to receive the wetted cellulose fiber from the spray booth. A chamber is configured to receive the wetted cellulose fiber from the conveyor at a fiber inlet. A hot air source is upstream of the fiber inlet, the hot air source directs a flow of hot air into the chamber. The wetted cellulose fiber are received into the flow of hot air in the chamber. A venturi is downstream of the fiber inlet. The venturi is configured to increase the velocity of the flow of hot air past the cellulose fibers. The conveyor is configured to provide about two minutes of dwell time between when the wetted cellulose fibers are received on the conveyor let and the wetted cellulose fibers are provided into the fiber inlet.

In an example of the system, the spray booth includes a vertically-oriented cylindrical housing. An inlet is positioned about a top of the cylindrical housing and is configured to receive the cellulose fibers and matrices of cellulose fibers. A rotatable shaft is positioned axially within the cylindrical housing. The rotatable shaft includes a plurality of vanes and paddles extending radially therefrom. A plurality of nozzles are arranged about the cylindrical housing and are configured to spray a mist of the liquid fire-retardant chemicals interior towards the rotatable shaft. The inlet may be oriented tangentially to the cylindrical housing and configured to receive the cellulose fibers under a force of a flow of air. Rotation of the rotatable shaft, vanes, and paddles within the cylindrical housing may create an updraft within the cylindrical housing that distributes and suspends the cellulose fibers within the cylindrical housing about the spray of the nozzles. The paddles may be angled upwards. The plurality of nozzles may be distributed circumferentially about the cylindrical housing at least two vertical heights within the cylindrical housing.

A method of producing cellulose insulation includes receiving the supply of input cellulose material. The input cellulose material is shredded into shredded cellulose material. The shredded cellulose material is ground to reduce the shredded cellulose material into pieces of cellulose and cellulose dust. Pieces of cellulose are ground with a fiberizer to reduce the pieces of cellulose into cellulose fibers and matrices of cellulose fibers and cellulose dust. The cellulose fibers and matrices of cellulose fibers are separated from the cellulose dust. The cellulose dust is collected as a merchantable byproduct. Liquid fire-retardant chemical is sprayed onto the cellulose fibers and matrices of cellulose fibers in the spray booth to produce wetted cellulose fiber. The wetted cellulose fiber is dried to produce cellulose insulation.

BRIEF DESCRIPTION OF THE DRAWINGS

Examples are described with reference to the following drawing figures. The same numbers are used throughout to reference like features and components.

The drawings illustrate embodiments for carrying out the disclosure. The same numbers are used throughout the drawings to reference like features and like components. In the drawings.

DETAILED DESCRIPTION OF THE DRAWINGS

The present disclosure generally relates to systems and methods for creating cellulose insulation from recycled materials and having the resulting properties of low density and low dust.

While prior efforts of liquid-based fire-retardant chemicals resulted in reduced chemical use and reduction of dust in the final insulation product, the inventors have recognized new challenges to the manufacture of cellulose insulation. Specifically, consumer and industrial use of newsprint paper stock has reduced while use of cardboard products has significantly increased. Recycled newsprint had been a preferred cellulose stock for manufacturing cellulose insulation as it was high quality, low density, and high surface area. Paper for recycling is classified in 12 major grades newsprint is considered "Grade 8" and exemplarily has a basis weight of 53 g/m2 (TAPPI: TIP 0404-36) Cardboard stock is thicker and thus has lower surface area, considered "Grade 11" or "Grade 12" and exemplarily has a basis weight of 247 g/m2. The inventors have recognized that cardboard stock, when processed according to existing cellulose insulation manufacturing processes, results in greater loss of cellulose input stock to dust and a lower conversion rate of the cellulose into the intended insulation product. The inventors have observed that cellulose insulation produced using current methods from 100% recycled cardboard stock may result in about 3 times w/w dust byproduct compared to cellulose insulation produced from 100% quality recycled newsprint stock (e.g. 20% dust versus 8% dust (w/w)).

Disclosed herein are improved systems and methods for the production of cellulose insulation, particularly from recycled cardboard cellulose stock.

Figure 1:
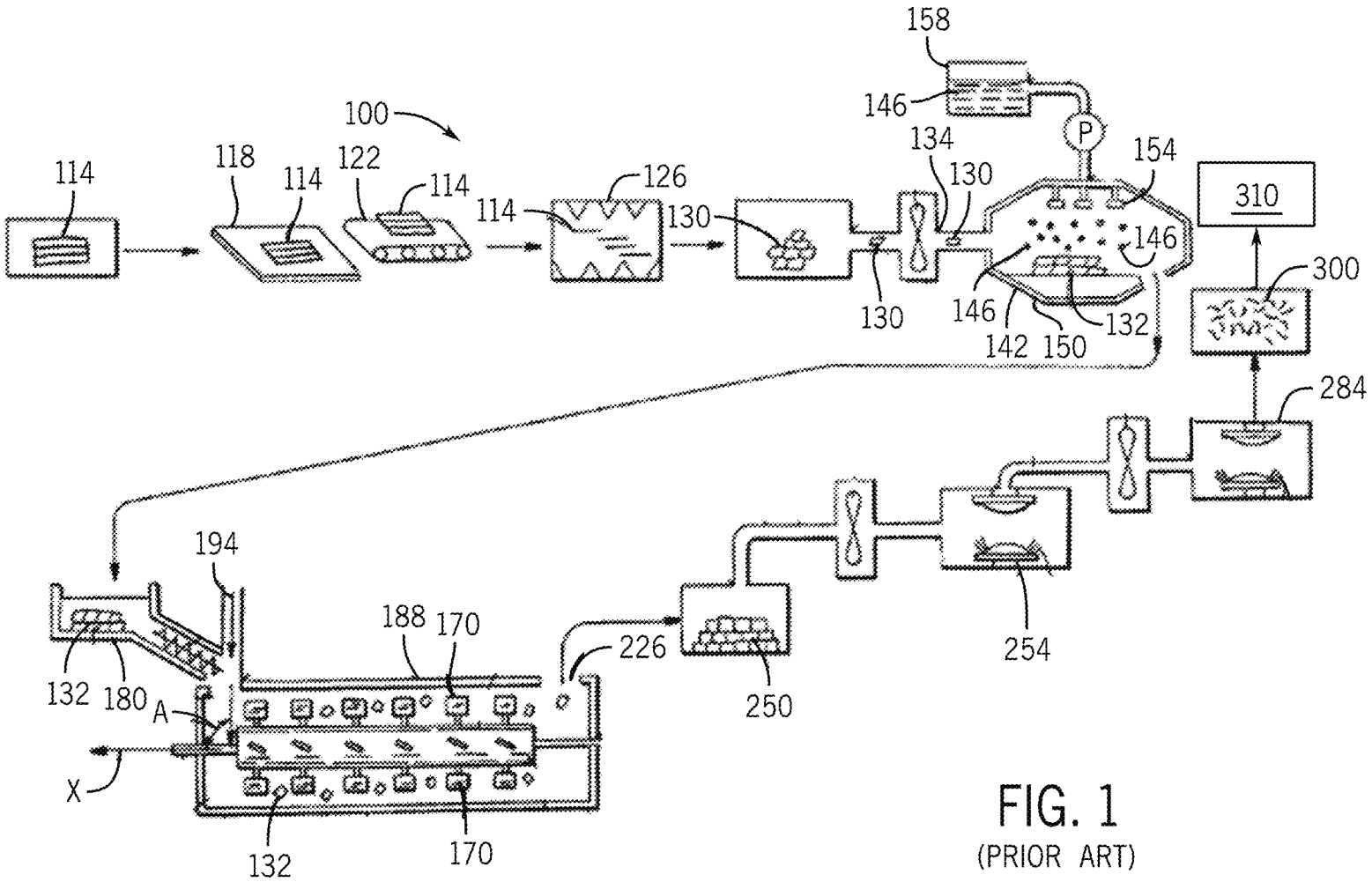
FIG. 1 (PRIOR ART)
FIG. 1 is a system diagram of a prior art processing system for producing cellulose insulation.
Figure 2:
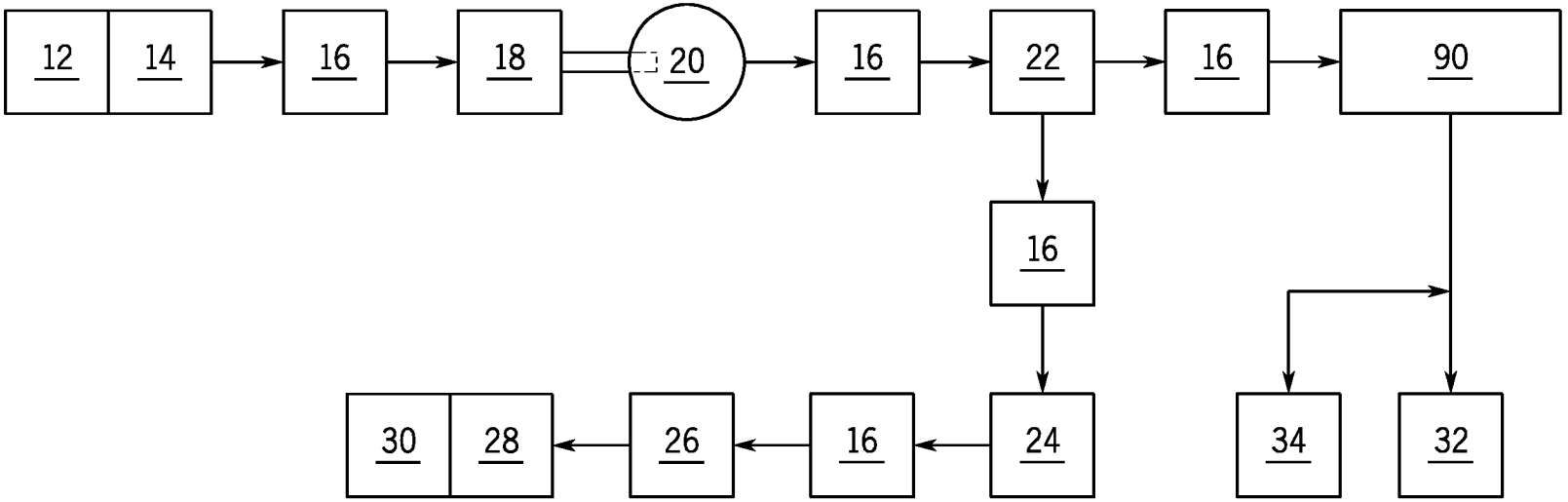
FIG. 2 is a system diagram of an example of the disclosed system for producing cellulose insulation.

FIG. 2 is a system diagram of an example of a system 10 for producing cellulose insulation, particularly from recycled paper materials comprising cardboard, and more particularly from recycled paper materials a majority of which is cardboard, up to an entirety of which is cardboard. It will be recognized that the input cellulose material used could be other forms of vegetable fibers, wood fibers, or other grades of paper including virgin or recycled paper. However, as noted above, recycled cardboard stock of Grade 11 or 12 has become the most widely available source of input cellulose material, while presenting the aforementioned challenges when processed into cellulose insulation. It will be recognized by a person of ordinary skill in the art that implementations of the system disclosed herein may include more or fewer components compared to that as shown and described. Combination or rearrangement of the described features with other structures known in the art will further be apparent to a person of ordinary skill in the art and are considered to be within the scope of the present disclosure.

The supply of input cellulose material in the form of post-consumer, post-commercial, and/or post-industrial cardboard is provided to a shredder 12. The shredder 12 receives the supply of input cellulose material and tears/grinds/cuts the cellulose material into shredded cellulose material having a roughly uniform size and dimension, each piece having an average width and length between 2-6 inches (5-15 cm), although such sizes are non-limiting and merely exemplary.

The shredded cellulose material is provided to a grinder, which is exemplarily a hammermill 14, to pulverize the cellulose material. The hammermill 14, or other grinding machine known to the cellulose processing art for the purpose of pulverizing shredded cellulose material, generally reduces the size of the shredded cellulose material pieces of cellulose having a generally uniform with an average piece having an area less than 4 square inches and having lengths or widths of about 0.25-2.0 inch (0.6-5 cm) and may have an average length or width of about 0.5 inch (1.3 cm). After reducing the input cellulose material to the pieces of cellulose, the system 10 may further rely generally upon an air transport system provided by one or more blowers 16 which produce an air flow through the system 10 which move the cellulose between and through further stages of the system. The blower 16 exemplarily includes an impeller which moves the air in the system 10 in the intended direction of operation. In examples, the pieces of cellulose collide with moving components of the blower, while some of this collision results in further reduction in the size of the pieces of cellulose, repeated collisions within the blower or within multiple blowers disposed within the system, produce excessively broken cellulose fibers or those fibers smaller than 0.01 inch (0.25 mm), or otherwise known herein as dust.

A blower 16 transports the pieces of cellulose from the hammermill 14 to a paper bin 18 in which the pieces of cellulose are collected so that a consistent feed of cellulose may be provided from the bin 18 to a fiberizer 20. In examples, fiberizers 20 are known in the industry to identify a category of machines which separate an input material, in this case cellulose material, into individual fibers. In one example, a hammermill may be operated as a fiberizer. In another example, the fiberizer 20 may be a mechanical device with at least one rotor grinding element in close proximity to at least one stator or counter-rotating grinding element such that when the cellulose material moves between the grinding elements, finely divided cellulose fibers are produced. The fiberizer 20 exemplarily reduces the individualized pieces of cellulose to cellulose fibers and matrices of fibers consisting of the fibers of the input cardboard cellulose material, which for example have a length of about 0.01-0.2 inch (about 0.25-5 mm). It is recognized that a small portion of fibers may make it through the process may have a length and/or width greater than 0.2 inch (0.5 cm). The output of the fiberizing process opens up and individualizes the fibers of the input cellulose material. However, it is recognized that the individual fibers may remain entangled or entwined with one another to some degree, thus referred to herein as a matrix of fibers, wherein individual fibers are exposed but not necessarily free to move apart from adjacent fibers. As previously noted, the size reduction processes described above, further produce a volume of cellulose dust biproduct, the amount of which is lost to cellulose insulation production. Additionally, it has been recognized that input cellulose material of cardboard in the above process results in about 3 times more dust compared to processing of newspaper input cellulose material (e.g. about 8% dust compared to about 20% dust). This loss of input cellulose material to dust lowers the yield of cellulose insulation end product from a comparable weight of input cardboard.

Figure 6A:
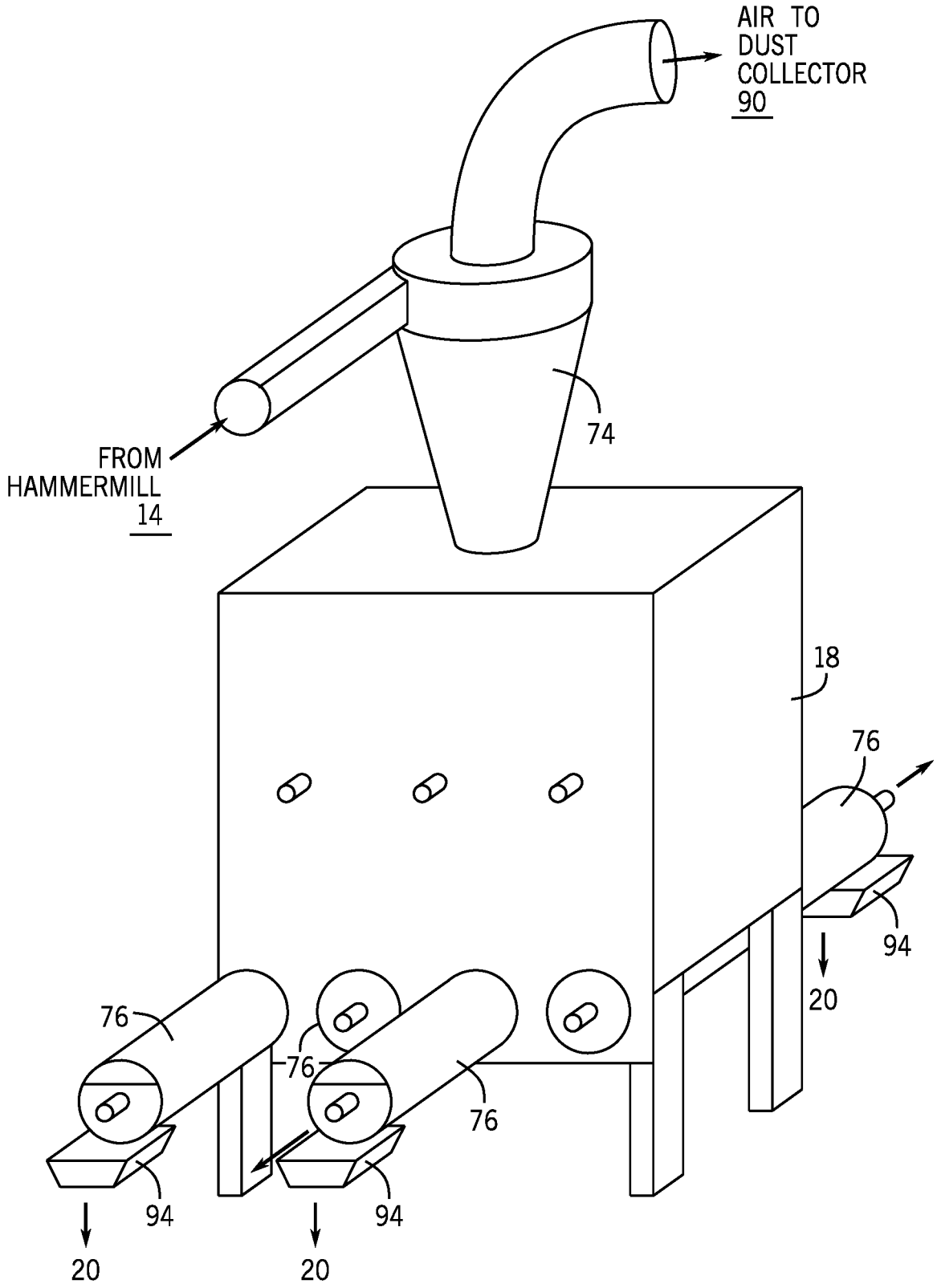
FIG. 6A-C depict examples of cellulose metering to a fiberizer system.
Figure 6B:
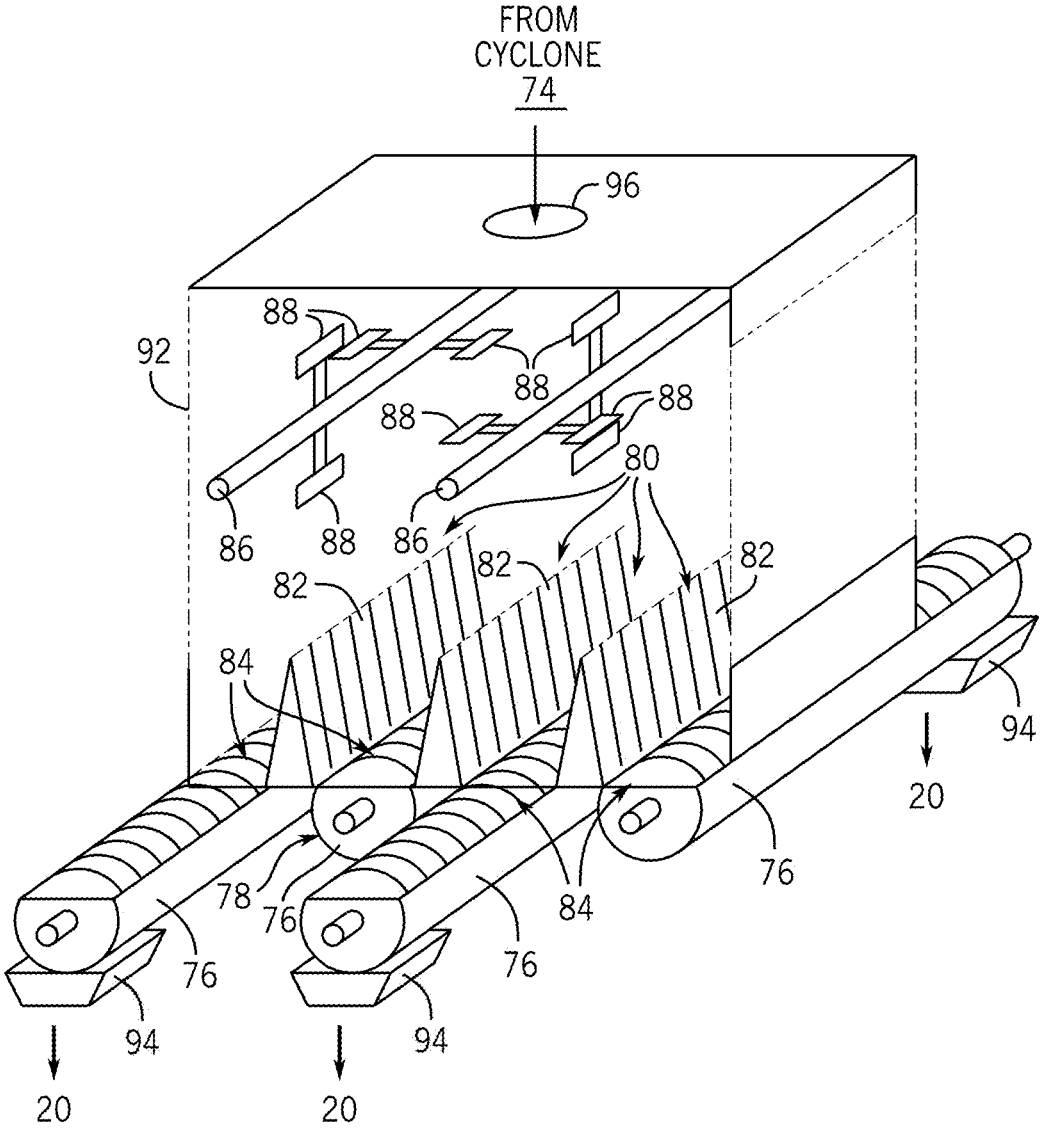
Figure 6C:
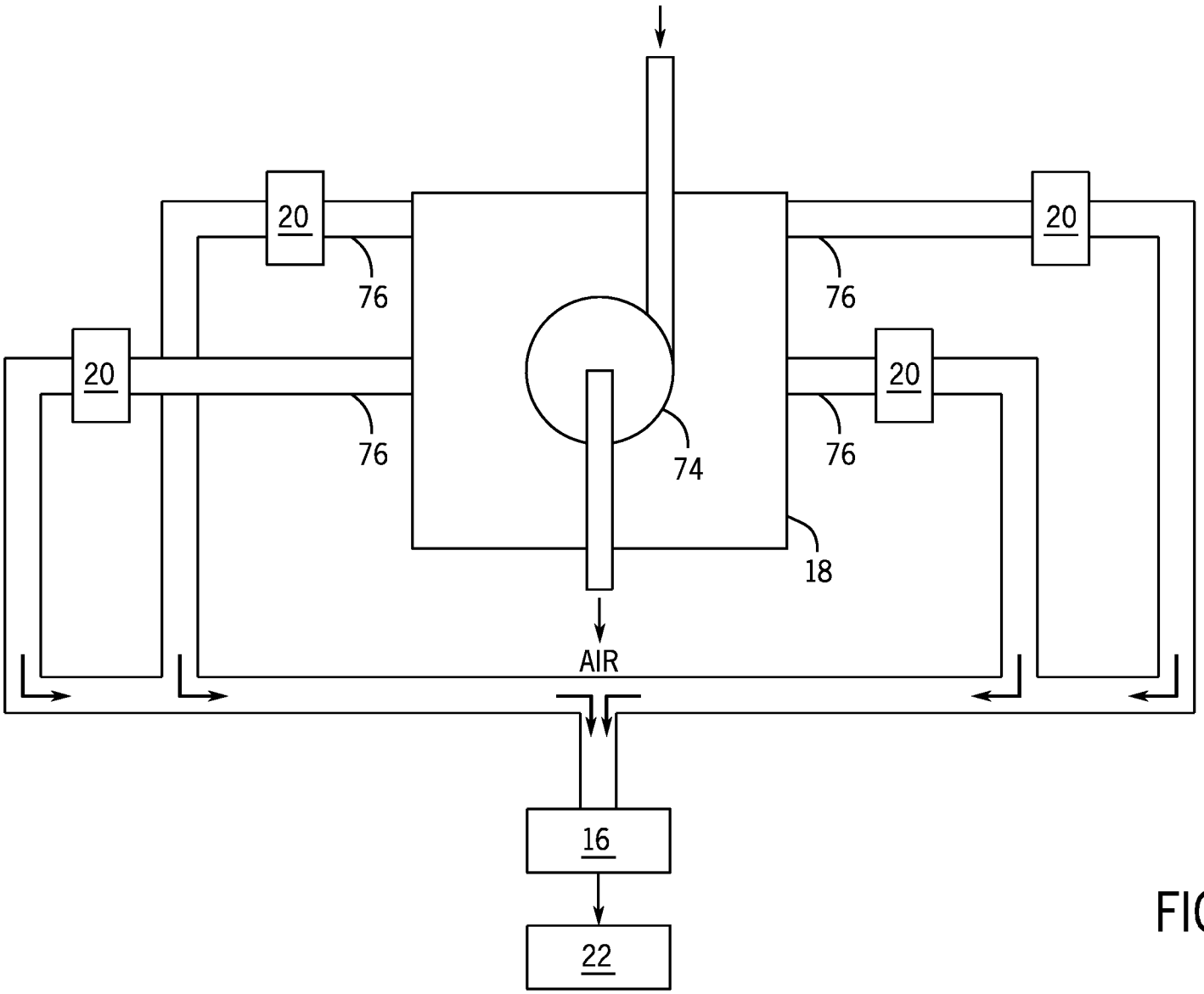

FIGS. 6A-6C depict an example of a fiberizer 20 arrangement which may be used in the system 10 of FIG. 2. As noted previously, fiberized cardboard creates a larger volume of output cellulose fiber (and thus a lower density) per pound of cardboard input cellulose material. At this increased volume (e.g. compared to processing/fiberizing newsprint input cellulose material), the same mass of cellulose from cardboard increases the dwell time of the cellulose within the fiberizer 20, resulting in the increased dust production compared to the processing of newspaper input cellulose material. The arrangement depicted in FIGS. 6A-C presents a solution to this problem by providing a metered supply of input pieces of cellulose to multiple fiberizers 20 arranged in parallel. With a metered supply of input pieces of cellulose to multiple fiberizers, the fiberizers may be operated at a reduced mass throughput (although not necessarily a reduced volumetric throughput) from each fiberizer, which the inventors have discovered results in less cellulose loss as dust and also reduction in the density of the output cellulose fibers.

A bin 18 is provided with a cyclone 74 to direct the pieces of cellulose from the hammermill (FIG. 2) into the bin 18 through a bin hole 96. At least a portion of the air from the blower 16 between the hammermill 14 and the bin 18 circulates within the cyclone 74 and is directed towards the dust collector 90 (FIG. 2), while the pieces of cellulose are provided out of the bottom of the cyclone 74 through the bin hole 96 into the bin 18. The bin 18 is connected to a plurality of fiberizers 20. In the example shown in FIG. 6C, the bin 18 is connected to four fiberizers 20, although this is merely exemplary and other systems may use more or fewer fiberizers in parallel than shown.

FIG. 6B depicts portions of bin side walls 92 in phantom to show the interior of the bin 18. Augers 76 are also depicted in a cut-away view. The augers 76 are arranged at positions at or below the bottom 78 of the bin 18. While the augers 76 are depicted in FIGS. 6A and 6B as extending outward from the bottom of the bin 18, it is equally recognized that the augers 76 may be located below the bin and extend outward therefrom. The augers 76 (within enclosures) extend away from the bottom of the of the bin 18. The inside of the bin 18 is divided into a plurality of troughs 80, each trough 80 defined by at least one angled wall 82 directed towards a respective auger 76 at the bottom of the trough 80 of the bin 18. Openings 84 at the bottom of the angled walls 82 expose the augers from the trough 80 to the interior of the bin 18. While not depicted, it is understood that the augers 76 are connected to motors to rotate the augers 76.

One or more rotating vanes 86 extend across the interior of the bin 18. The vanes 86 are positioned above the troughs 80 and towards the bin hole 96. The vanes 86 include shafts 98 from which paddles 88 extend. The vanes 86 rotate about the axis of the shafts 98 to rotate the paddles 88. While not depicted, it is understood that the shafts 98 of the vanes are connected to motors to impart the rotation on the vanes 86. The rotating vanes 86 evenly distribute the pieces of cellulose as it enters the bin 18 through the bin hole 96 across the troughs 80. The pieces of cellulose settle into the troughs 80. The angled walls 82 of the troughs 80 extend partially into the interior of the bin 18 promoting even distribution of the cellulose pieces among the troughs 80 as should one trough become filled with cellulose pieces up to the height of the wall 82, additional cellulose pieces will be directed into other less full troughs. The pieces of cellulose in the troughs 80 are directed towards the augers 76 by the at least one angled wall 82 of the trough 80. The rotating augers 76 pull the pieces of cellulose from the bottom of the troughs 80 and out of the bin 18 to auger outlets 94 at the exposed ends of the augers away from the bin 18 and to the respective fiberizers 20. With an even distribution of cellulose material between the troughs 80 and each of the augers having the same dimensions and rotation speed, the cellulose material is evenly metered between the fiberizers 20.

The evenly metered cellulose material is provided in parallel to the fiberizers 20. The number of fiberizers 20 provided in the system may be sufficient to not exceed a predetermined maximum weight or volumetric throughput of cellulose material through the fiberizers 20, such that less cellulose dust is created. The outputs of the fiberizers 20 are re-combined, for example with the use of one or more blowers 16 to direct the cellulose fibers and (reduced amount of) cellulose dust to the de-duster 22. It will be recognized that in examples, multiple augers 76 may supply a single fiberizer 20. Additionally, the system may further monitor or measure a weight or volume of cellulose material at the input or at another point in the system and control the augers in operation accordingly. For example, even though the system depicted includes four augers 76, during operation, upon monitoring the throughput of the system, one, two, three, or four of the augers 76, and associated fiberizer(s) 20, are operated to use the fewest augers 76 and fiberizers 20 at a given time to maintain a processing throughput through the fiberizers below the predetermined maximum. In examples, these values may be empirically determined and programmed into a controller (not depicted) associated with the augers 76 and fiberizers 20, to modulate the operation of these parallel systems.

A subsequent blower 16 directs the cellulose fibers and the cellulose dust to a de-duster 22, for example as described in U.S. Pat. Nos. 9,045,605 and 10,767,306, although other similar arrangements may be used within the scope of the present disclosure. The de-duster 22 exemplarily includes screening, air classification, or a combination of both of these techniques to separate the cellulose fibers from the cellulose dust.

The combined cellulose fibers and cellulose dust are provided into the de-duster 22, which exemplarily includes a screen with a mesh size that is suitable for effectively separating a sufficient amount of cellulose dust from the cellulose fibers, by removing at least about 50% of the volume of the dust content, preferably about 70%-100% of the dust content, and more preferably about 90%-100% of the dust content. In an example the mesh of the screen can range from about 200 mesh to about 10 mesh, preferably about 40 mesh to about 14 mesh, and more preferably about 30 mesh to about 20 mesh. The screen is structured to facilitate movement of the cellulose material across the screen for example by rotating, vibrating, or other mechanical motion of the screen, while in other examples, an air supply streams and/or pulses air relative to the material and the screen to agitate the material on the screen. A non-limiting example of a de-duster includes the Model VS0048 and VS0060 gyratory separators available from VORTI-SIV®, a division of Industries, Inc., Salem, Ohio, USA.

In contrast to previous approaches, the presently disclosed system and method applies the liquid fire-retardant chemicals to the fiberized and de-dusted cellulose material. The cellulose fibers, having been separated from the cellulose dust, are directed into a spray booth 24 where a mist of the liquid fire-retardant chemicals is applied to the cellulose fibers. One example of a spray booth is described in U.S. Pat. No. 9,045,605. It has been found that when the liquid fire-retardant chemicals are applied to the cellulose fibers in this condition, that a significant reduction in fire-retardant chemical use can be achieved. In examples for testing purposes, it has been observed that application of the liquid fire-retardant chemicals produce wetted (e.g. prior to drying) cellulose fiber containing about 7% by weight of the fire-retardant chemicals, which is approximately ½ to ¼ of the fire-retardant chemical use under prior systems.

Figure 3:
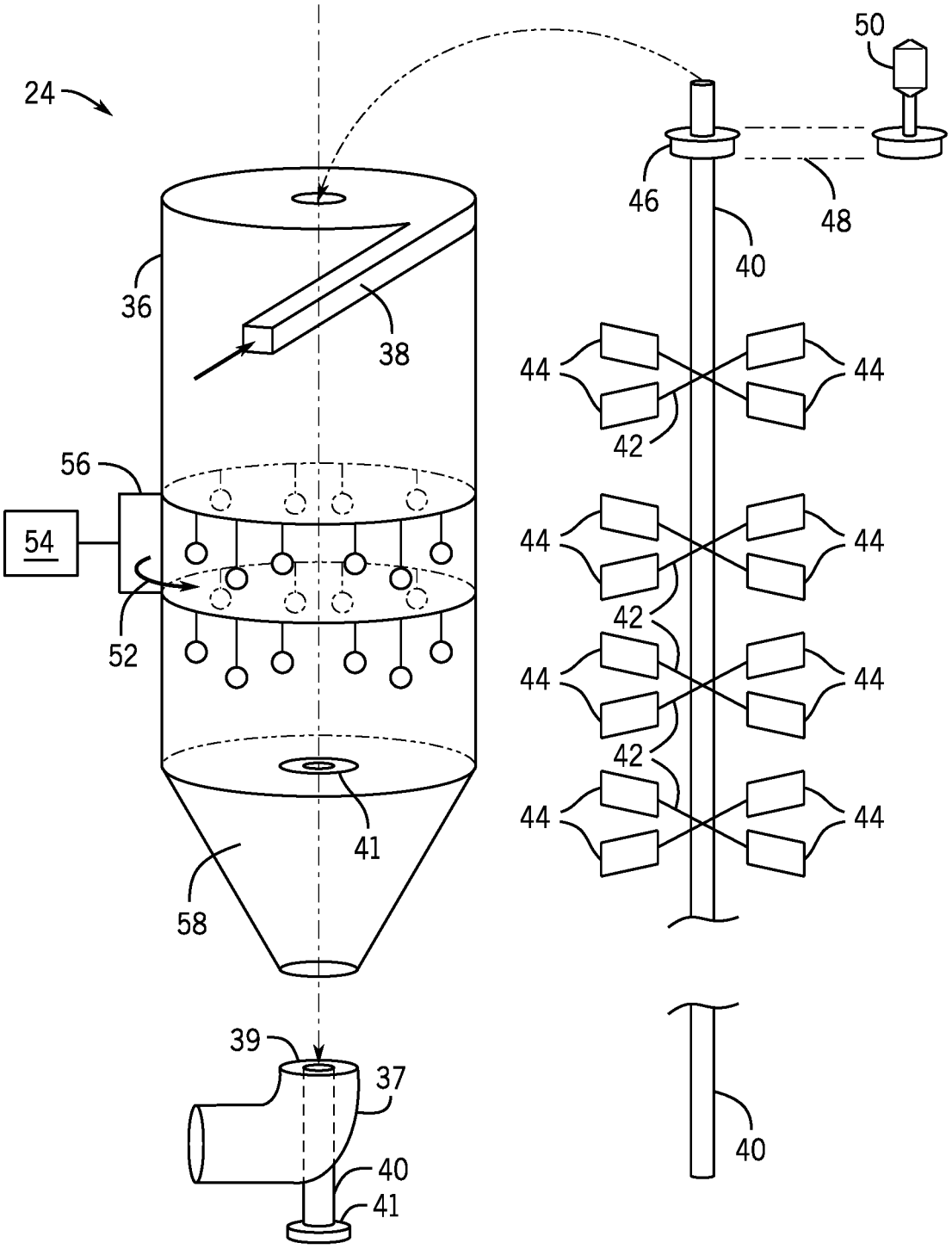
FIG. 3 is an exploded view of an example of a spray booth.

FIG. 3 presents an exploded view of an example of a spray booth 24 developed to effectively treat the cellulose fibers with the spray of liquid fire-retardant chemicals. The spray booth 24 includes a vertically-oriented cylindrical housing 36. While the size and dimensions of the spray booth are generally dependent upon the intended cellulose material throughput, a spray booth 24 consistent with the described system may be approximately 10 feet in height and 4 feet in diameter. An inlet 38 is formed at the top of the cylindrical housing 36 and tangentially enters the cylindrical housing 36. The cellulose fibers enter the inlet 38 from the de-duster 22.

A shaft 40 extends axially through the cylindrical housing 36 of the spray booth 24. Bearings exemplarily retain the shaft 40 axially within the cylindrical housing 36 allowing rotation of the shaft 40. In an example, the shaft 40 may terminate, for example, at an end bearing 41 at the bottom of the cylindrical housing, or may extend through the cylindrical housing, through a funnel 58 at the bottom of the cylindrical housing 36 and terminate in an end bearing 41 in an elbow 37 in the duct 39 extending away from the spray booth 24 or exit the elbow 37 to terminate the end bearing 41. Other lengths and constructions of the shaft 40 may be further recognized from the present disclosure. A plurality of vanes 42 extend radially outward from the shaft 40. A paddle 44 is at the end of each vane 42. Rotation of the shaft 40 results in rotation of the vanes 42 and paddles 44 about the vertical axis of the cylindrical housing 36. The paddles 44 are angled upwards so as to create an updraft of air against the flow of air and cellulose fibers into the spray booth 24. A sheave 46 and a belt 48 mechanically connect the shaft 40 to a motor 50. Operation of the motor 50 causes the shaft 40 to rotate, correspondingly, the motor output controls the speed that the shaft 40 rotates.

As noted, the cellulose fibers enter the spray booth 24 through the inlet 38 under the force of blower air transport from the de-duster 22. The cellulose fibers and the incoming air enter the spray booth 24 tangentially along an inner surface of the cylindrical housing 36. The rotating shaft 40, vanes 42 and paddles 44 further agitate the flow of air and cellulose fibers and create a vortex of air that suspends the cellulose fibers within the spray booth 24. The cellulose fibers are generally directed towards the cylindrical housing 36 by centrifugal force. A plurality of nozzles 52 are distributed about the cylindrical housing 36 and are directed to spray interior toward the center of the cylindrical housing. The operation of the rotating shaft 40, vanes 42, and paddles 44 keep the cellulose fibers free flowing within the spray booth, but also positioned in proximity about the nozzles 52. The cellulose fibers are wetted with the spray from the nozzles across the large surface area presented by the cellulose fibers within the spray booth. A pump 54 and supply line 56 are connected to the nozzles 52 to provide the liquid fire-retardant chemical to the nozzles under pressure. In an example, the liquid fire-retardant chemical is provided at 40 psi, although this will be understood to be merely exemplary and pressures between 30-50 psi may be used. In still further examples systems may use less or more pressure than that range. In a further example, the nozzles may be a size 6 and the spray booth may have twelve nozzles. In a still further examples, the booth may include 10, 12, or 20 nozzles in a single plane through the spray booth, and the plurality of nozzles may be arranged in multiple planes, including but not limited to 2-6 planes of nozzles. However, these too, are merely exemplary and the number, size, and distribution of nozzles 52 may be fewer or greater than this example.

The plurality of nozzles 52 produce a misting spray of the liquid fire-retardant chemical with a droplet size for example between 40-200 microns. The spray is directed radially inwards to the interior of the cylindrical housing 36 in a cone shape, although other spray distribution shapes, including fan shapes, may be used. As noted, the rotation of the shaft 40, vanes 42, and paddles 44 produce a vortex that suspends the cellulose fibers within the spray booth 24. The low density of the cellulose fibers facilitates this suspension and the large mass volume of the cellulose fibers compared to the input cellulose material or shredded cellulose material volumetrically fills the interior of the spray booth 24 radially adjacent the misting spray of the nozzles 52 in a constantly moving distribution of cellulose fibers. These conditions lead to near-complete retention of the liquid fire-retardant chemical on the cellulose fibers. It has further been found that this spray booth configuration is operative with less solvent use, thereby enabling the liquid fire-retardant chemical treatment with a solution concentration between about 40%-60% and preferably about 50% although other solution concentrations may be used within the scope of the present disclosure. As the cellulose fibers are wetted with the liquid fire-retardant chemical, the density of the wet fibers increases, this combined with stream of air and new cellulose fibers introduced through the inlet 38, eventually pulls the wetted cellulose fibers to the bottom of the cylindrical housing 36 where a funnel 58 transition directs the wetted cellulose fibers out of the spray booth for drying.

After the cellulose fibers are wetted with the liquid fire-retardant chemicals, the cellulose fibers are dried in a drying system 26. As previously noted, the liquid fire-retardant chemicals are composed of fire retardant chemicals in a solvent, exemplarily an aqueous solvent. Evaporation of the solvent with heat and air leaves the fire-retardant chemicals entrained in and on the cellulose fibers. One example of a drying system 26 is described in U.S. Pat. No. 9,045,605.

Figure 4:
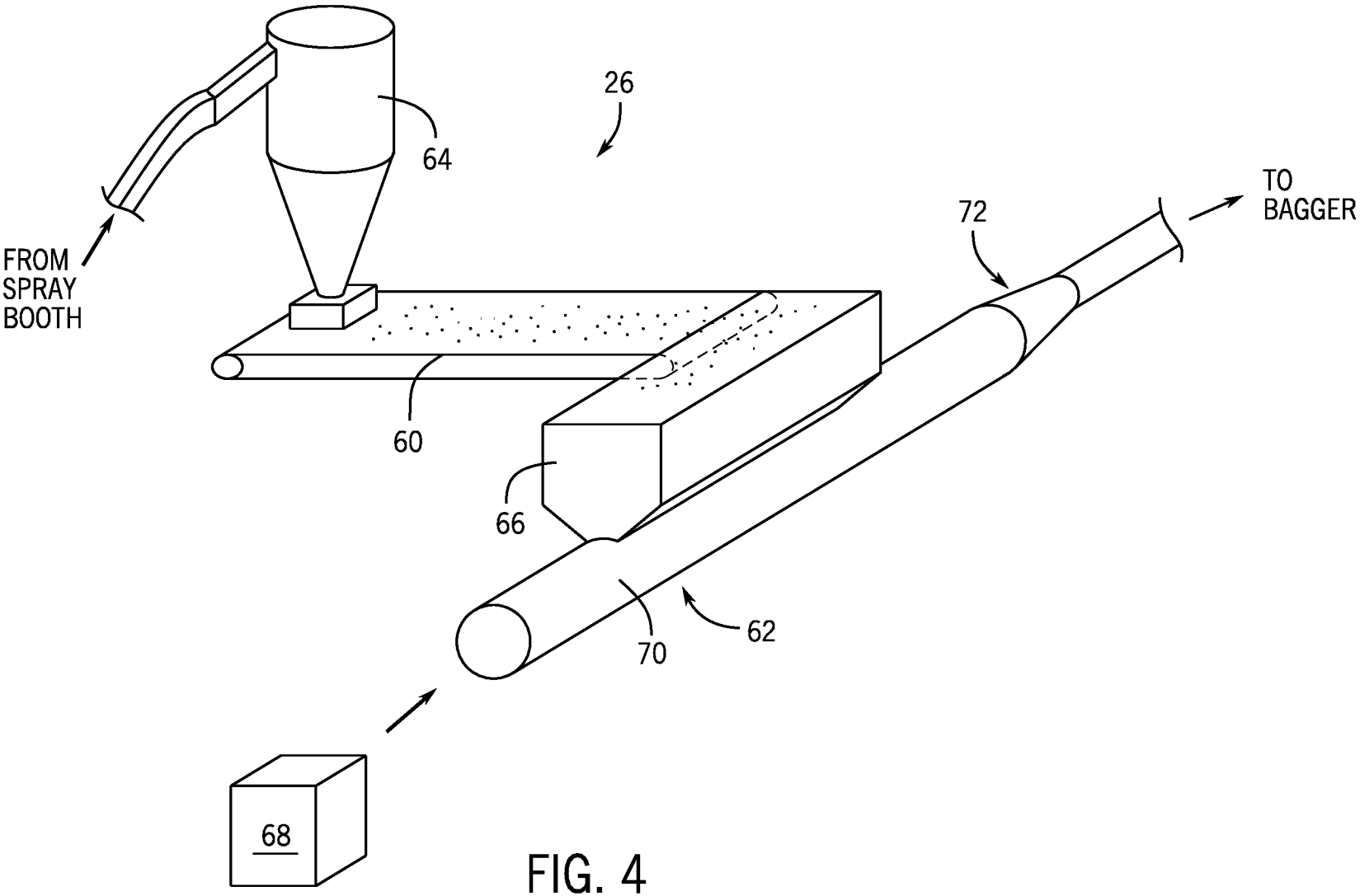
FIG. 4 is a system diagram of an example of a dryer system.

FIG. 4 presents a further example of a drying system 26 developed for use in connection with the system as described herein. As previously described, the liquid fire-retardant chemicals are a solution of a solvent and the fire-retardant chemicals. Once the cellulose fibers are wetted with the liquid fire-retardant chemicals, the solvent is evaporated from the cellulose fibers, to leave the fire-retardant chemicals in the cellulose fiber. The drying system 26 includes two stages for the drying process. A soak belt 60 gives the wetted cellulose fiber a dwell time to help ensure penetration of the liquid fire-retardant chemical into and along the cellulose fiber. A dryer 62 uses heated air to evaporate the remaining solvent.

The drying system 26 includes a cyclone 64 which receives the wetted cellulose fibers from the spray booth 24 by air transport. The cyclone 64 circulates the wetted cellulose fibers to reduce fiber clumping and deposit an even distribution of the wetted cellulose fibers onto the soak belt 60. The soak belt 60 is a conveyor constructed with a length and operational speed such that the wetted cellulose fibers rest on the soak belt 60 for a duration of two minutes. This has been found to be an adequate dwell time for penetration of the liquid fire-retardant chemicals into and onto the cellulose fibers. It will be recognized that due to the movement of air and the partial pressure of the liquid solvent, that the drying/evaporation process may occur in some amount and rate starting from the time that the cellulose fibers are wetted in the spray booth. At the end of the soak belt 60, the wetted cellulose fibers are provided into a hopper 66, which functions to provide an even and continuous distribution of the wetted cellulose fibers into the dryer 62.

The dryer 62 is exemplarily includes a source 68 of a forced flow of hot air. This may exemplarily include a burner (e.g. electric or gas burner) combined with a blower as previously used elsewhere in the air transport system. The forced flow of hot air is provided into the drying chamber 70 of the dryer 62, where the hopper 66 provides the wetted cellulose fibers into the flow of hot air. Downstream of the hopper 66 a Venturi 72 increases the air flow velocity within the dryer. Due to the mass of the cellulose fibers, the air in the dryer 62 speeds up relative to the cellulose fibers, increasing the rate at which the hot air flows across the surface area of the cellulose fibers quickly evaporating any remaining solvent of the liquid fire-retardant chemical. The dried cellulose fibers are then provided for bagging.

The dried, fire retardant treated, cellulose fibers are now suitable for use as cellulose insulation. The cellulose insulation is collected in a bagger bin 28 to accumulate the cellulose insulation from which a consistent feed of cellulose insulation may be provided to a bagging machine 30. It will also be recognized that the cellulose insulation may be provided to a baler machine consistent with the commercial delivery of the cellulose insulation product. Bagging machines 30 as well as baler machines are known and used in the art to package the cellulose insulation for transport for sale and use. In use, the cellulose insulation is placed into a hopper and mechanically separated and fluffed up, and then blown into place, for example in walls or attics of commercial or residential buildings.

As recognized by the inventors in U.S. Pat. No. 10,767,306, the cellulose dust, separated from the cellulose fibers by the de-duster 22, may be collected in a dust collector 90 for separate commercial applications and products. In an example, a blower 16 is provided to transport the separated cellulose dust from the de-duster 22 to the dust collector 90 which may be a bin or receptacle to contain the dust for subsequent processing, for example with a bagger 32 as described above, or by a pelletizer, 34, which presses the cellulose dust into pellets. While U.S. Pat. No. 10,767,306 recognized uses for collected cellulose dust, that dust biproduct disclosed in U.S. Pat. No. 10,767,306 was downstream of the treatment of the cellulose with the fire-retardant chemicals. This constrained the potential uses of the collected cellulose dust biproduct. With the system and method as presently described, the collected cellulose dust is fire-retardant chemical free, resulting in a more versatile commercial product. Examples of the use of the collected cellulose dust from the presently described systems and methods include, but are not limited to, mulch, co-gen, woodburning pellets, asphalt enhancements, and cat litter.

The inventors have surprisingly discovered numerous advantages gained from the cellulose insulation system and process as described herein. These benefits include a final cellulose insulation with a lower bulk density, an improved cellulose insulation yield from recycled cardboard cellulose material stock, and reduced fire-retardant chemical use.

Figure 5A:
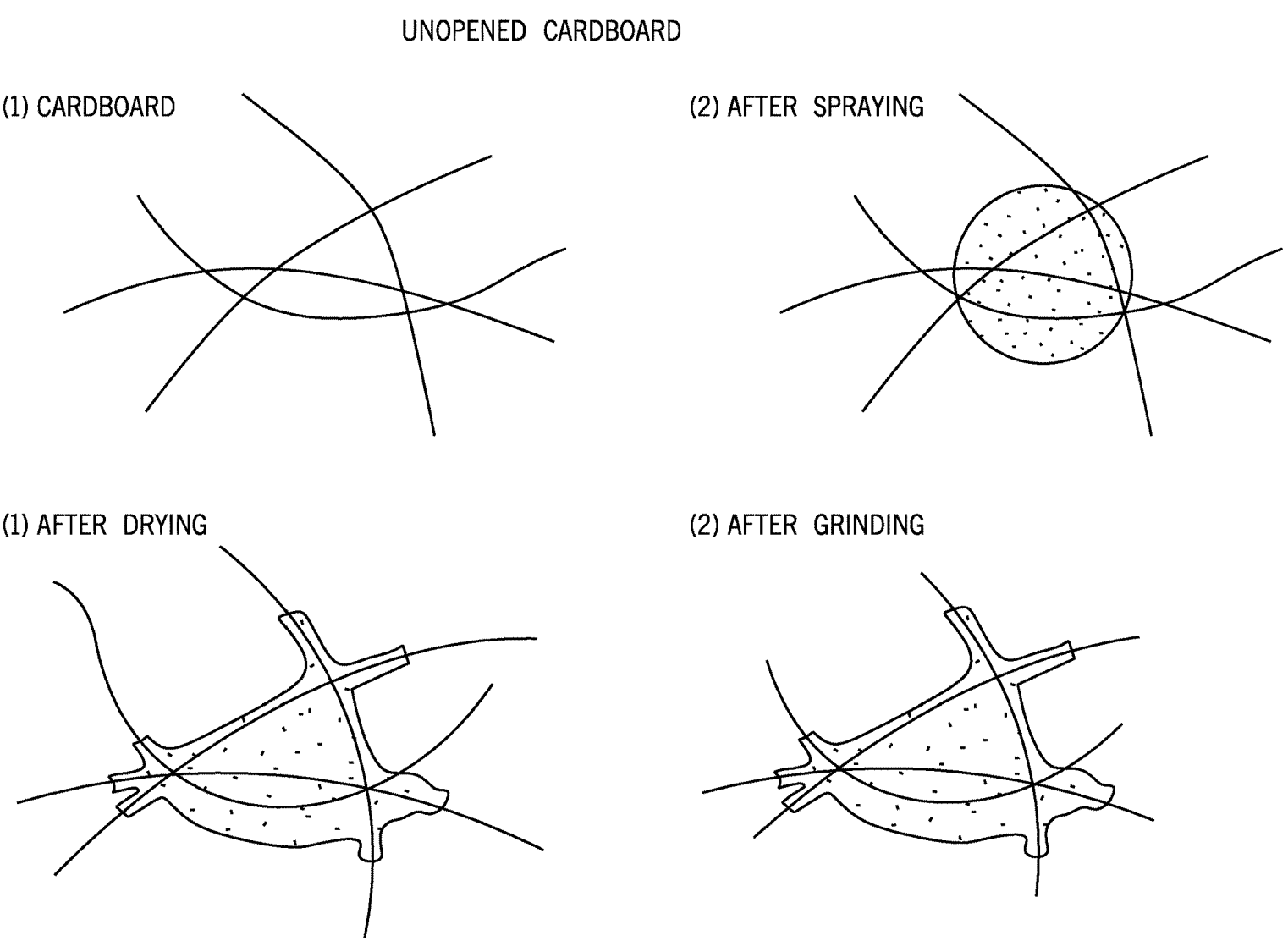
FIG. 5A depicts drying of fire-retardant chemicals on shredded cardboard on a fiber size scale.

Upon investigation, the inventors have discovered that during liquid fire-retardant chemical treatment of the shredded cellulose material (e.g. having width and length between 2-6 inches (5-15 cm)) resulted in the formation of crystalline chemical structures, particularly on the surface of the cellulose material as the liquid evaporated. When a mixed Borate solution dries, the precipitate forms a hard glass of high durability. When such a solution is sprayed onto a piece of unopened cardboard the capillary effect of the fiber web of the cardboard causes a certain amount of the solution to be trapped in the interstices of the fiber web of the cardboard. Upon drying, this durable glass holds some of the interlocked web fibers together, thereby preventing their later dispersion during subsequent fiberizing processes. The addition of surfactant was observed to reduce the formation of this glass, but does not eliminate it. FIG. 5A depicts this process. During subsequent reduction of the shredded cellulose material to cellulose fibers for example with a hammermill and/or fiberizer, these borate glass structures bind cellulose fibers. Bound cellulose fibers resist individualization during these reduction processes and increased bulk density of the final cellulose insulation product.

Figure 5B:
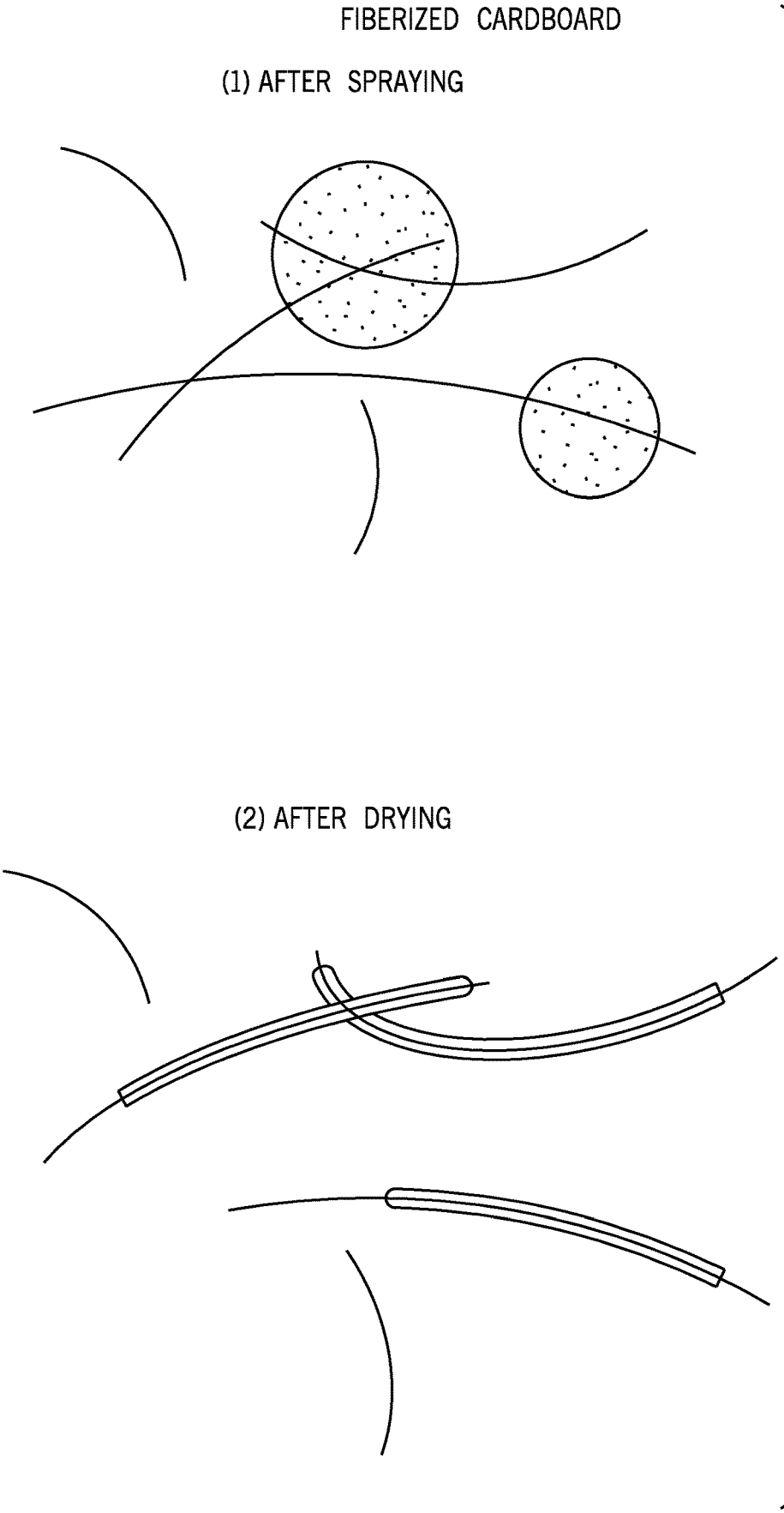
FIG. 5B depicts drying of fire-retardant chemicals on individual cellulose fibers on a fiber size scale.

FIG. 5B depicts the process under the presently-disclosed system and process. In FIG. 5B, when the fiberized cellulose fibers or matrices of cellulose fibers as described above from recycled cardboard are sprayed with a Borate fire-retardant solution, the solution simply coats the already individualized individual fibers. Upon drying, the hard Borate glass instead contributes rigidity to the fiber and prevents breaking and flexing which would otherwise have led to an increase in cellulose insulation density. It has been found that spraying fully fiberized cardboard reduces chemical requirements by about 12% (from about 8% to 7%) and reduced density by 14% (from about 1.4 pcf to 1.2 pcf).

Relatedly, the inventors further discovered that the same crystallization binding of cellulose fibers in the shredded cellulose material also caused the cellulose material to flow less freely and to dwell longer within the hammermill and/or fiberizer machines, this dwell causes over-processing and the increased formation of cellulose dust. Note that in FIG. 5A, the fibers are bound closer together within the Borate glass and more of the fibers extending out of the Borate glass are broken off after grinding compared to the more whole (constrained to the length of fiber in the input cellulose material) fibers represented in FIG. 5B. The inventors thus discovered that an improved yield of cellulose fibers compared to cellulose dust, particularly from recycled cardboard cellulose input material is achieved by moving the liquid chemical treatment after the cellulose material has been reduced to cellulose fibers. Moreover, the fiber materials in the final or completed insulation product as described herein have a higher degree of rigidity which may result in more loft and in less settling of the product when used in a building structure.

Lastly, under previous processes the liquid fire-retardant chemicals were applied to the entire volume of cellulose material introduced into the system to achieve a required effective concentration of fire-retardant chemical in the cellulose material. However, under such processes, the known yield of cellulose fiber from recycled cardboard input cellulose material is approximately 80%, with about 20% loss as cellulose dust. By moving the liquid chemical treatment to after the de-dusting process, only fire-retardant chemical needed to treat the yielded cellulose fibers from the input cellulose material is needed. Furthermore, the inventors discovered that due to the lower surface area of the shredded cellulose material compared to the increased surface area of the cellulose fibers (on a weight-to-weight comparison). The prior liquid fire-retardant chemical treatment resulted in more evaporative losses of fire-retardant chemicals. That is, the greater density and lower surface area of the shredded cardboard exposed more of the liquid fire-retardant chemicals to evaporation and drying of the solvent from the liquid fire-retardant chemicals, whereby a portion of the fire-retardant chemicals crystallized prior to entrainment within any cellulose fibers, and were subsequently separated from the cellulose due to the air flow and mechanical processes in the system. This loss of chemical required greater input concentrations of fire-retardant chemicals to achieve an effective amount of treatment of the cellulose insulation. By moving the liquid fire-retardant chemical treatment to the end of the process and after the cellulose dust is separated from the cellulose fibers, more chemical is entrained with the cellulose fibers, resulting in less chemical use to achieve the same effective treatment.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives, and modifications are possible within the scope of the appended claims.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. The patentable scope of the invention is defined by the claims and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A spray booth for producing cellulose insulation, the spray booth comprising:

a vertically-oriented cylindrical housing;

an inlet positioned about a top of the cylindrical housing and configured to receive cellulose fibers and matrices of cellulose fibers;

a rotatable shaft positioned axially within the cylindrical housing, the rotatable shaft comprising a plurality of vanes and paddles extending radially therefrom, wherein rotation of the rotatable shaft, vanes, and paddles within the cylindrical housing is configured to create an updraft within the cylindrical housing that distributes and suspends the cellulose fibers within the cylindrical housing; and a plurality of nozzles arranged about the cylindrical housing and configured to spray a mist of liquid fire-retardant chemicals interior towards the rotatable shaft and onto the suspended cellulose fibers and matrices of cellulose fibers to produce wetted cellulose fiber.

2. The spray booth of claim 1, wherein the inlet is oriented tangentially to the cylindrical housing and is configured to receive the cellulose fibers under a force of a flow of air.

3. The spray booth of claim 1, wherein the paddles are angled upwards.

4. The spray booth of claim 1, wherein the plurality of nozzles are distributed circumferentially about the cylindrical housing at at least two vertical heights within the cylindrical housing.

5. The spray booth of claim 1, further comprising an end bearing mounted interior of the cylindrical housing, wherein the rotatable shaft engages and rotates within the end bearing.

6. The spray booth of claim 1, further comprising a funnel at the bottom of the cylindrical housing and a duct extending from a bottom of the funnel, wherein the duct comprises an elbow and the cylindrical shaft extends axially through the cylindrical housing and the funnel exits the duct about the elbow.

7. A system for producing cellulose insulation, the system comprising:

a shredder configured to receive a supply of input cellulose material, and shred the cellulose material;

a fiberizer configured to receive the cellulose material after being shredded by the shredder, the fiberizer configured to reduce the cellulose material to cellulose fibers and matrices of cellulose fibers and cellulose dust;

a de-duster configured to receive the cellulose fibers and matrices of cellulose fibers and cellulose dust, and separates the cellulose fibers and matrices of cellulose fibers from the cellulose dust;

a spray booth comprising a vertically-oriented cylindrical housing, an inlet positioned about a top of the cylindrical housing and configured to receive the cellulose fibers and matrices of cellulose fibers, a rotatable shaft positioned axially within the cylindrical housing, and a plurality of nozzles arranged about the cylindrical housing and configured to spray a mist of liquid fire-retardant chemicals interior towards the rotatable shaft and onto the cellulose fibers and matrices of cellulose fibers to produce wetted cellulose fiber; and a dryer configured to receive the wetted cellulose fibers and to dry the wetted cellulose fiber to produce cellulose insulation.

8. The system for producing cellulose insulation of claim 7, wherein the input cellulose material is cardboard.

9. The system for producing cellulose insulation of claim 7, wherein the shredder is configured to produce shredded cellulose material and further comprising a grinder configured to receive the shredded cellulose material and reduce the shredded cellulose material to pieces of cellulose and cellulose dust and the fiberizer is configured to reduce the pieces of cellulose to cellulose fibers and matrices of cellulose fibers and cellulose dust.

10. The system for producing cellulose insulation of claim 7, wherein the cellulose dust is collected from the de-duster as a fire-retardant chemical free byproduct.

11. The system for producing cellulose insulation of claim 7, wherein the cellulose fibers and matrices of cellulose fibers are fibers consistent with a fiber construction of the input cellulose material.

12. The system for producing cellulose insulation of claim 11, wherein the cellulose fibers have an average length between 0.01-0.2 in (0.25-5 mm).

13. The system for producing cellulose insulation of claim 11, wherein the de-duster is configured to remove any cellulose fibers having a length less than 0.01 in (0.25 mm).

14. The system for producing cellulose insulation of claim 7, wherein the fiberizer is a hammermill.

15. A method of producing cellulose insulation, with the system of claim 7, the system comprising:

receiving the supply of input cellulose material;

shredding the input cellulose material with the shredder;

grinding the cellulose material shredded by the shredder with the fiberizer to reduce the cellulose material to cellulose fibers and matrices of cellulose fibers and cellulose dust;

separating the cellulose fibers and matrices of cellulose fibers from the cellulose dust with the de-duster;

collecting the cellulose dust as a merchantable byproduct;

spraying liquid fire-retardant chemical onto the cellulose fibers and matrices of cellulose fibers in the spray booth to produce wetted cellulose fiber; and drying the wetted cellulose fiber in the dryer to produce cellulose insulation.

16. A system for producing cellulose insulation, the system comprising:

a shredder configured to receive a supply of input cellulose material and shred the cellulose material;

a metering bin having an interior and configured to receive the cellulose material after being shredded by the shredder, the metering bin comprising:

a first trough extending upwards into the interior;

a first auger at a bottom of the first trough;

a second trough extending upwards into the interior; and a second auger at a bottom of the second trough;

a first fiberizer configured to receive the cellulose material from the first auger and reduce the cellulose material to cellulose fibers and matrices of cellulose fibers and cellulose dust;

a second fiberizer configured to receive the cellulose material from the second auger and reduce the cellulose material to cellulose fibers and matrices of cellulose fibers and cellulose dust;

a de-duster configured to receive the cellulose fibers and matrices of cellulose fibers and cellulose dust from the first and second augers, and configured to separate the cellulose fibers and matrices of cellulose fibers from the cellulose dust;

a dust collector configured to receive the cellulose dust;

a spray booth configured to receive the cellulose fibers and matrices of cellulose fibers, the spray booth comprising a vertically-oriented cylindrical housing, an inlet positioned at a top of the cylindrical housing, a rotatable shaft comprising a plurality of vanes and paddles extending radially therefrom positioned axially within the cylindrical housing, and a plurality of nozzles arranged about the cylindrical housing and configured to spray a mist of liquid fire-retardant chemicals interior towards the rotatable shaft onto the cellulose fibers and matrices of cellulose fibers to produce wetted cellulose fiber; and a dryer configured to receive the wetted cellulose fibers on a conveyor belt, a chamber configured to receive the wetted cellulose fibers from the conveyor belt at a fiber inlet, a hot air source upstream of the fiber inlet, the hot air source directing a flow of hot air into the chamber, wherein the wetted cellulose fibers are received into the flow of hot air in the chamber, and a venturi downstream of the fiber inlet, the venturi configured to increase the velocity of the flow of hot air past the cellulose fibers to dry the cellulose fibers to produce cellulose insulation.

17. The system for producing cellulose insulation of claim 16, wherein the shredder is configured to produce shredded cellulose material and further comprising a grinder configured to receive the shredded cellulose material and reduce the shredded cellulose material to pieces of cellulose and cellulose dust and the first and second fiberizers are configured to reduce the pieces of cellulose to cellulose fibers and matrices of cellulose fibers and cellulose dust.

18. A spray booth for producing cellulose insulation, the spray booth comprising:

a vertically-oriented cylindrical housing;

an inlet positioned about a top of the cylindrical housing and oriented tangentially to the cylindrical housing and configured to receive cellulose fibers and matrices of cellulose fibers under the force of a flow of air;

a rotatable shaft positioned axially within the cylindrical housing, the rotatable shaft comprising a plurality of vanes and paddles extending radially therefrom; and a plurality of nozzles arranged about the cylindrical housing and configured to spray a mist of liquid fire-retardant chemicals interior towards the rotatable shaft and onto the cellulose fibers and matrices of cellulose fibers to produce wetted cellulose fiber.

* * * * *